United States Patent [19]

Hovsepians

[11] 4,437,704

[45] Mar. 20, 1984

[54] MODULAR FURNITURE WITH REMOVABLE OUTER FABRIC

[75] Inventor: Vigen M. Hovsepians, Los Angeles, Calif.

[73] Assignee: Vivar, Incorporated, Glendale, Calif.

[21] Appl. No.: 284,408

[22] Filed: Jul. 17, 1981

[51] Int. Cl.[3] ..... A47C 4/02

[52] U.S. Cl. ..... 297/440; 5/12 R; 5/490; 5/491; 5/499; 297/218; 297/219; 297/DIG. 1

[58] Field of Search ..... 297/218, 219, 440, DIG. 1; 5/12 R, 490, 491, 492, 498, 470, 471, 499

[56] References Cited

U.S. PATENT DOCUMENTS

| | | | |
|---|---|---|---|
| 1,469,523 | 10/1923 | McGarvey | 5/490 |
| 1,871,003 | 8/1932 | Longletz et al. | 5/490 |
| 2,131,609 | 9/1938 | Alexander | 5/492 X |
| 3,266,066 | 8/1966 | Bereday | 297/DIG. 1 |
| 3,663,055 | 5/1972 | Gale | 297/440 |
| 3,675,970 | 7/1972 | Bereday | 297/DIG. 1 |
| 3,740,774 | 6/1973 | Powell | 5/12 R |
| 4,169,625 | 10/1979 | Peterson | 297/440 |
| 4,192,032 | 3/1980 | Geraci | 5/465 |
| 4,319,781 | 3/1982 | Tsuge | 297/219 X |

*Primary Examiner*—James T. McCall

*Attorney, Agent, or Firm*—Blakely, Sokoloff, Taylor & Zafman

[57] ABSTRACT

Items of furniture are disclosed comprising at least one integral contoured interior element made of foamed material molded and/or cut into desired shapes or contours with an inner lining made of a smooth stretchable material covering the interior element and an outer material form fitted to cover the inner lining and interior element. In a second aspect of the invention, in a sofa embodiment, means for maintaining the planar relationship between the backrest and the arm rest portions of the sofa are disclosed; and means for supporting a backrest portion of a sofa when the backrest portion can not be supported by a wall of the room where the sofa is located are also disclosed.

8 Claims, 9 Drawing Figures

Fig. 1
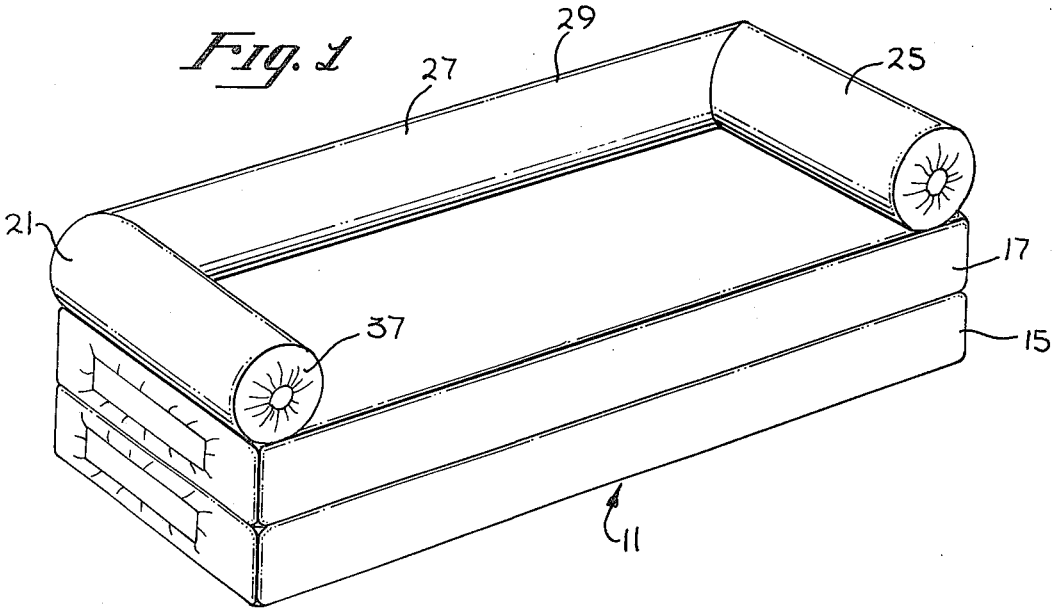
Fig. 2
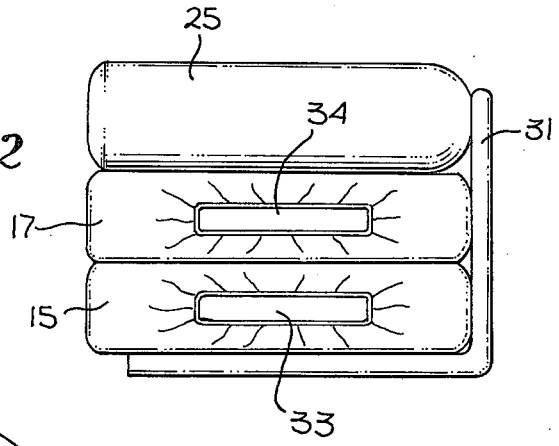
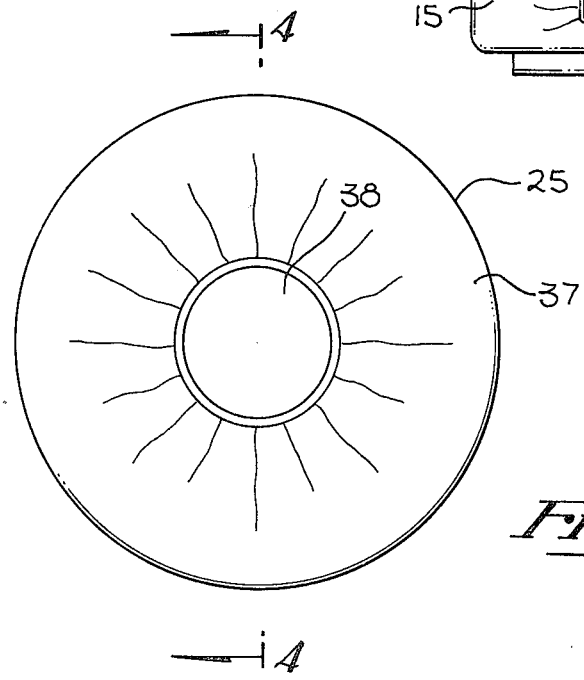
Fig. 3

MODULAR FURNITURE WITH REMOVABLE OUTER FABRIC

PRIOR ART STATEMENT

Resilient foam molded and/or cut in the shape or contour of pillows, bolsters, ottomans, chairs, couches and the like, are well known as means to provide the support structure of various items of modular furniture. The complete item of furniture comprises the contoured support structure covered by a suitable upholstery covering.

Generally, upholstery coverings for such items of modular furniture are precut and stitched to conform to the shape of the contoured support structure to be covered. The precut and stitched material is then placed on the support structure and secured thereto in manner making its removal difficult at best, and in some types of furniture impossible without destroying the upholstery covering. For example, a zipper may be provided on the upholstery covering thereby making its removal possible. However, in view of the substantial friction present between such prior art upholstery coverings and the foamed material, it is very difficult to place the covering on or remove the covering from the support structure.

In addition to zippers, other means are known to enable upholstery coverings to be placed on furniture and removed therefrom. In particular, U.S. Pat. No. 3,338,630 teaches removable seat covers for automobile cushions comprising a seat cover with two pairs of oppositely disposed hems which are bowed outwardly or away from each other. A continuous stretchable drawstring is provided in the hems. When the drawstring is stretched, it tends to straighten or move the hems toward each other, which in turn stretches or tightens the seat cover material on a cushion to be covered.

Additionally, the item of furniture may have means for supporting the foamed material comprising stiff or resilient members imbedded within the foam. See, for example, U.S. Pat. No. 3,967,852 which teaches imbedding a supporting core member in an article of furniture made of a foamed material and U.S. Pat. No. 4,191,424 which teaches a support grid including a series of parallel, closely spaced apart spring wires to the ends of which a pair of side strands are connected. The side strands serve to center and support bolsters with respect to a main cushion area. Other references which teach means for providing support for items of furniture include U.S. Pat. Nos. 3,706,473, 3,807,801, 3,827,751 and 4,032,191.

SUMMARY OF THE INVENTION

Items of furniture are disclosed comprising at least one integral contoured interior element made of foamed material molded and/or cut into desired shapes or contours with an inner lining made of a smooth stretchable material covering the interior element and an outer material form fitted to cover the inne lining and interior element. In a second aspect of the invention, in a sofa embodiment, means for maintaining the planar relationship between the backrest and the arm rest portions of the sofa are disclosed; and means for supporting a backrest portion of a sofa when the backrest portion can not be supported by a wall of the room where the sofa is located are also disclosed.

The foamed material is molded and/or cut in the shape of pillows, bolsters, ottomans, chairs, and sofa cushions. For example, a sofa may comprise two rectangularly shaped cushions with identical length and width, with one cushion disposed on top of the other cushion. Cylindrically shaped bolsters, i.e., armrests and backrest for the sofa, may be comprised of foamed material with the armrests coupled to respective ends of the backrest and disposed in perpendicular relationship thereto, forming an approximately U-shaped structure. The backrest, armrests structure is disposed on the top cushion and aligned thereupon in the usual manner.

The inner lining comprises a material known in the upholstery industry as interlock nylon which is knitted so that it may be stretched in both its length and width dimension to approximately twice the respective dimensions when the material is not under tension. The inner lining is placed on the interior elements so as to substantially cover the interior elements. The inner lining provides a "slippery" surface which enables the outer covering to be easily pulled over the interior elements. Without the inner lining, the outer covering would snag against the foam comprising the interior elements making it very difficult to place the outer material on or remove the material from the interior elements.

The outer material, that is the upholstery cover, is also capable of being stretched in its length and width dimensions. The outer material is sewn together so that when it is placed on the interior elements, over the inner lining, the outer material appears to be form fitted.

The outer material is placed at one end of a portion of the furniture to be covered, for example, in the sofa embodiment, one of the seat cushions, and pulled across the cushion in a manner similar to placing a sock on one's foot. Once the outer material has been pulled over the cushion, the ends of the material form an opening at each end of the cushion. To close off these ends and provide a pleasing, upholstered look, drawstrings are provided in hems sewn in the perimeters at the two ends of the outer material. With the outer material in place, the drawstrings are pulled, thereby drawing the perimeters inwardly, and tied to secure the upholstery covering. After the drawstrings have been pulled and tied, the upholstery covering at each end of the member has an appearance similar to the tied end of a duffle bag. The drawstrings may be untied and the covering removed for cleaning or replacement by the owner of the furniture. Inasmuch as there will still be a small opening at the ends of the cushion even after the drawstrings are tied, a small patch of the outer material may be placed inside each opening thereby providing a finished look.

In the second aspect of the invention, substantially rigid metal members are coupled in perpendicular relation, forming a U-shaped member, which is imbedded inside the cylindrical foam member comprising the armrests and backrest of the sofa, thereby maintaining the horizontal relation of the backrest and armrests.

In the sofa embodiment, when the back of the sofa is not against a wall, if a person were to sit down on the sofa and lean back, the backrest, armrests structure would tend to be pushed off the cushion of the sofa. To preclude this from occuring, two L-shaped metal members are joined at ends of corresponding legs by a connecting metal member such that the two L-shaped members are maintained in parallel relation. The free ends of the unjoined legs are placed under the bottom seat cushion between the cushion and the floor, with the connected pair of legs and the connecting member disposed behind the backrest portion. The weight of the cushions and a person sitting on the sofa holds the L-shaped structure in place which in turn prevents the backrest, armrests structure from being pushed off the top cushion. The L-shaped structure, although partially exposed, may be covered with the same outer material thereby blending the L-shaped structure in with the sofa such that the structure is not easily seen.

DESCRIPTION OF THE DRAWINGS

FIG. 1 is a perspective view of a sofa embodying the subject invention.

FIG. 2 is a side elevation view of the sofa.

FIG. 3 is a front elevation view of one arm of the sofa.

DETAILED DESCRIPTION OF THE INVENTION

Figure 4:
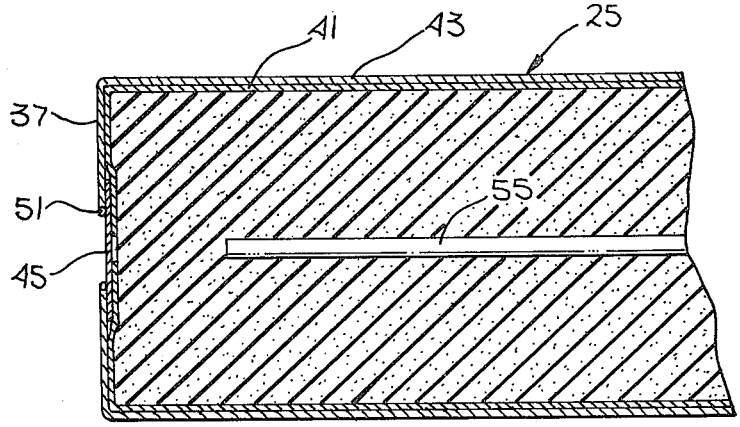
FIG. 4 is a cross sectional side elevation view taken along line 4—4 of FIG. 3.
Figure 5:
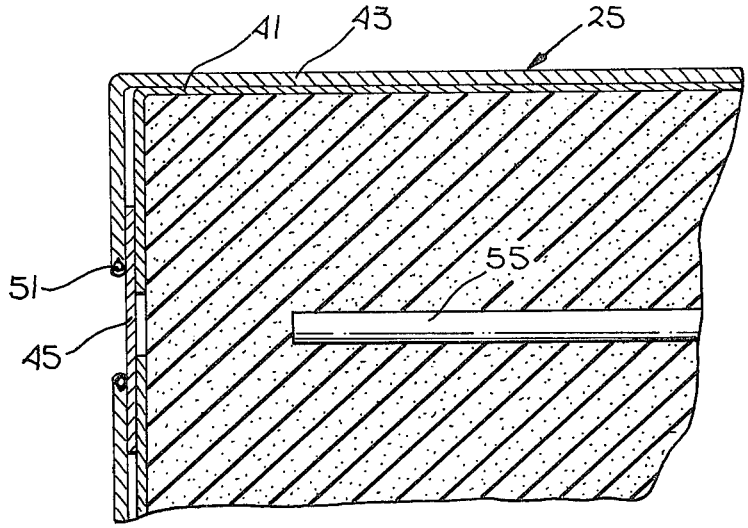
FIG. 5 is an enlarged view of FIG. 4 showing the details of the front portion of the armrest.

Items of furniture made from form molded and/or cut foamed material with an upholstery covering which may be easily placed on or removed from this foamed material is disclosed. Means are provided for maintaining the planar relation between the backrest and armrests of a sofa made from foamed material. Additionally, means are provided for supporting the backrest portion of the sofa when the backrest portion can not be supported by a wall of a room where the sofa is located.

Details of making the foamed material and cutting or molding it into items of furniture are well known in the art and to avoid unnecessary complicating the subject invention such details will not be provided herein. Generally the density of the foamed material used in connection with the subject invention ranges from 1.05 to 1.80 pounds per cubic foot, with an indent load depression ranging from 18 to 55 pounds plus or minus 3 pounds.

Referring to FIG. 1, a sofa 11 is shown embodying the various aspects of the subject invention. The sofa comprises a first rectangularly shaped seat cushion 15 and a second substantially identically shaped second seat cushion 17 disposed on top of the first seat cushion. The first seat cushion 15 rests on the floor of the room where the sofa is located. The two seat cushions are not coupled to each other. Thus, the seating portion of the sofa comprises a single relatively large cushion made from form molded or cut foamed material. The sofa further comprises armrests 21 and 25 and a back rest 27. The armrests, backrest combination is formed from cylindrically shaped foamed material. The two armrests 21 and 25 are connected to respective ends of the backrest 27 such that a single approximately U-shaped structure 29 is formed. The U-shaped structure 29 may then be placed on the sofa 11 on cushion 17 thereby providing a sofa made from foamed material.

Just as the top cushion 17 is not connected to the bottom cushion 15, the U-shaped structure 29 is not connected to the top cushion 17. Usually, the back of the sofa 11 is adjacent to and supported by a wall and the fact that member 29 is not connected to cushion 17 is of no concern. However, when the sofa is not disposed adjacent a wall, a person sitting on the sofa and leaning back on the backrest 27 could cause the entire U-shaped structure 29 to fall off the rear of the sofa. In such circumstance, and as will be described more fully hereinbelow, a support member 31 is disposed such that one pair of legs are under cushion 15 between the cushion and the floor and a second pair of legs are disposed adjacent the back portion of the sofa in a manner which will prevent U-shaped structure 29 from falling off the sofa 11 as above described.

Referring now to FIGS. 2 through 6, the details of the upholstery covering of the subject invention will now be described. Although this description will be with reference to armrest 25, the teachings of the subject invention apply in an analogous manner to cushions, ottomans, chairs and the like.

Generally, both foam and the fabrics utilized for upholstering are rough textured. Moreover, aesthetics requires that upholstery coverings fit snuggly on items of furniture being covered. Thus, an upholstery cover must be substantially form fitted to the underlying structure of an item of furniture. In view of the tight fit required by the upholstery covering and the rough texture of the fabric and the foam, the upholstery covering tends to constantly snag on the foam as the material is pulled over the foam.

As a means to alleviate this problem, the subject invention teaches that an inner lining 41 comprised of a knitted nylon stretch yarn may be disposed between the upholstery covering 43 and the foam 31. The inner lining should be comprised of a material which is smooth textured, having a relatively low coefficient of friction, and capable of being stretched to approximately twice its length and width when not under tension. One yarn which has been found to be capable of satisfying the foregoing requirements is 100% nylon stretch which may be obtained from Burlington Madison Yarn Company. The yarn may be knitted in a normal interlock knit.

The inner lining 41 may be placed on the foamed material 31 by dimensioning the lining so that it will snugly fit on the foamed material. For example, if the foamed material to be covered is cylindrically shaped, the inner lining may be in the shape of tube with a diameter slightly less than the diameter of the cylinder. One end of the tube is placed over one end of the cylinder and the tube is pulled across the cylinder in a manner similar to placing a sock on one's foot. The stretchability and smoothness of the nylon enables it to be easily pulled across the foamed material. Generally, the inner lining need not be removed and it may be secured to the foamed material in any convenient manner such as by gluing, or tying its ends in a manner to be described hereinbelow in conjunction with the outer material. Once the inner lining is fully in place and secured to the foamed material, the size and shape of the foamed material is substantially identical to that before the inner lining was placed thereon.

Once the inner lining 41 is placed on the foamed material 31 and secured thereto, it is a simple manner to pull the outer material 43 across the inner lining in a manner similar to that which was employed when pulling the inner lining over the foamed material. The smooth texture of the inner lining as well as its stretchability, enables the outer material to be pulled across the inner material in an effortless manner.

Figure 6:
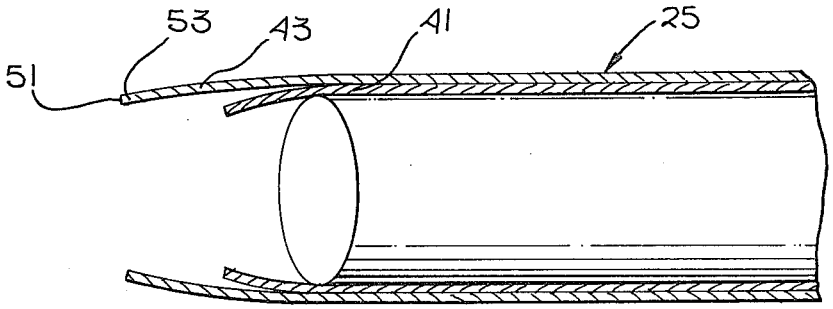
FIG. 6 is a side elevation view of the arm of the sofa before the inner lining and outer covering have been secured thereto.

Once the outer material 43 is in place, it is necessary to secure it to the item of furniture in a manner giving a finished upholstered look. To provide such finished upholstered look, as best seen in FIG. 6, a string 51 is disposed in a hem 53 formed at an end of outer material 43. Of course, the opposite end of the tube comprising outer material 43 may also have a similar string, hem structure. As the two ends of the string 51 protruding from the hem 53 are pulled, the perimeter or outer edge of the end of the outer material is drawn inwardly in a manner similar to pulling the drawstring of a duffle bag. Depending on the extent to which the outer material extends beyond the end of the foamed material which is being covered, the size of the hole 38 formed thereby may be as large as the diameter of the foam being covered or so small as to substantially cover the end 37 of the armrest 25.

Once the string 51 has been pulled as tightly as desired, a knot is tied in the string securing the outer material 43 to the foamed material. Regardless of the final diameter of hole 38, it will always be possible to see the inner lining and/or foam through such hole. To preclude such possibility, a small piece of outer material 45 is placed into the hole such that it is disposed between the inner lining 41 and the outer material 43. After the material 45 is placed, all that shows through hole 38 is outer material 45.

Should it become necessary to remove the outer material 43 such as for cleaning or for replacing it, the knot in string 51 may be untied. By placing one's fingers inside hole 38 and pulling outwardly, the diameter of hole 38 increases and the outer material 43 may be pulled across the inner lining and off the item of furniture in a manner analogous to that with which it was placed thereon.

Figure 7:
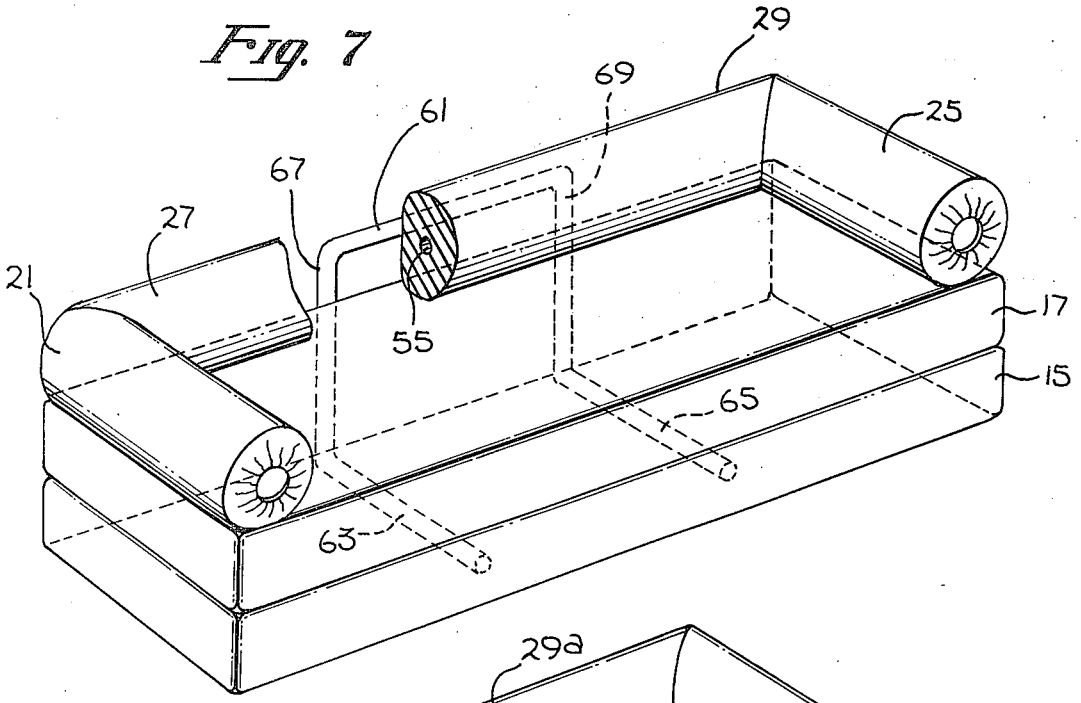
FIG. 7 is a perspective view of the sofa showing the back rest support means.

Referring now to FIG. 7 a second aspect of the subject invention may now be more fully described. Support member 31 is comprised of two L-shaped members, for example, one inch steel tubing, joined at corresponding ends of legs 67, 69 of each L-shaped member such that the two L-shaped members are in parallel relationship. The legs 63 and 65 whose ends are not coupled, are disposed under cushion 15 between the cushion and the floor on which the sofa sits. The other pair of legs 67 and 69 extend from behind the sofa to a position at least approximately half way up backrest 27. When a person sits on the sofa, his weight plus the weight of the cushions 15 and 17 hold support member 31 in place. If the person should lean back on backrest 27, support member 31 will prevent the U-shaped structure 29 from sliding off the sofa.

Figure 8:
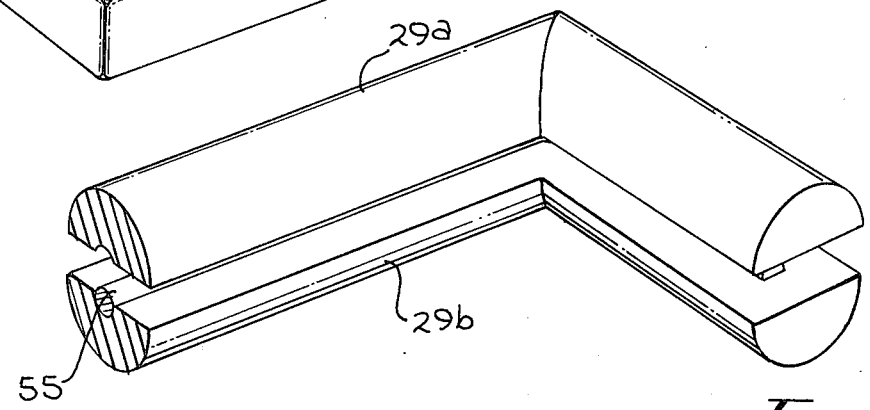
FIG. 8 is a perspective view of the sofa armrests and backrest portion cut in half showing the support member imbedded therein.

Referring now to FIG. 8, means for maintaining the arm rests 21 and 25 and backrest 27 in horizontal relationship will be described. As discussed hereinabove, the two armrests and the backrest form an approximately U-shaped member 29. In order to maintain this planar relationship, a correspondingly shaped metal member is imbedded within member 29. Member 29 may be cut lengthwise in half with support member 55 placed between the two halves **29*a* and 29*b*. After support member 55 is disposed between the two halves such that it is approximately centered, the two halves are glued together and the added strength of support member 55 maintains the armrests 21 and 25 and the backrest 27** in planar relationship.

Figure 9:
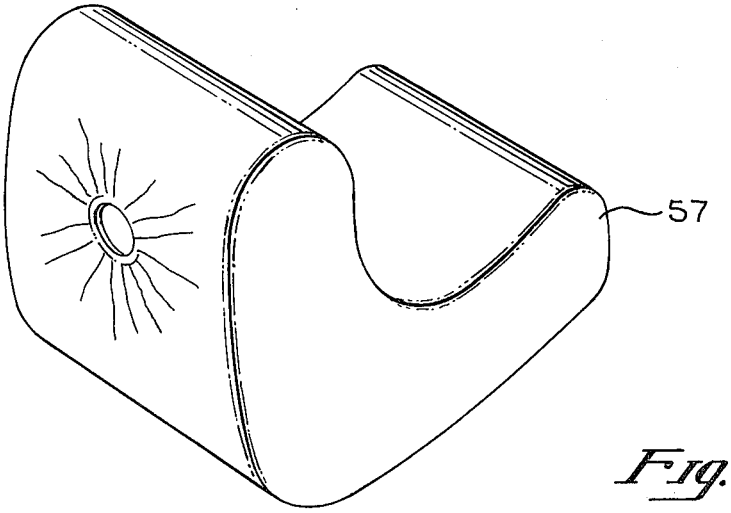
FIG. 9 is a perspective view of a chair embodying the subject invention.

Referring now to FIG. 9, a chair 57 embodying the invention disclosed herein is shown. As described hereinabove, the foam is first covered with an inner lining comprised of a smooth textured, stretchable material. The upholstery covering is then pulled from one end of the chair across the inner lining to the other end of the chair at which time, strings disposed at respective ends of the chair are pulled like the draw strings of a duffle bag. A small piece of outer material is inserted into the hole between the outer material itself and the inner lining thereby providing a finished upholstered look.

While the foregoing description made reference to only the sofa and chair embodiments of the subject invention and defined certain specific materials to be used for producing such items of furniture, it will be obvious to those skilled in the art that various departures from such specific references, such as other items of furniture and other materials having similar characteristics, may be made without departing from the spirit and scope of the invention as disclosed and claimed herein.

I claim:

1. An item of furniture comprising:

(a) at least one integral, contoured interior element;

(b) an inner lining disposed in contacting relationship with and substantially covering said interior element, said inner lining comprised of a material, having a relatively low coefficient of friction and which, when under tension, is capable of stretching approximately twice in each of its length and width dimensions as when not under tension;

(c) a readily removable and replaceable outer material disposed in a slidable relationship with and substantially covering said inner lining;

(d) means for removably securing said outer material to said interior element, whereby said inner and outer materials fit conformly with respect to the contours of said interior element and said outer material is able to slide easily over said inner lining, and is readily removable from and replaceable over said interior element.

2. The item of furniture defined by claim 1 wherein said outer material has at least one open end and said securing means comprises a string disposed adjacent the perimeter of one end of said outer material within a hem sewn into the outer material, whereby pulling on said string causes said perimeter to decrease in size and secure said outer material to said interior element.

3. The item of furniture defined by claim 1 wherein said inner lining is comprised of a material knitted from a nylon yarn.

4. The item of furniture defined by claim 1 wherein said outer material stretches when under tension and restores to its original shape when tension is removed.

5. The item of furniture defined by claim 4 wherein said outer material comprises a material knitted from an acrylic yarn and a nylon yarn.

6. A sofa comprising:

(a) an integral, contoured, interior seat cushion;

(b) a first inner lining disposed in contacting relationship with and substantially covering said seat cushion, said first inner lining comprised of a material, having a relatively low coefficient of friction and which, when under tension, is capable of stretching approximately twice in each of its length and width dimensions as when not under tension;

(c) a readily removable and replaceable first outer material disposed in slidable relationship with and substantially covering said first inner lining;

(d) an integral, contoured interior bolster, having a first armrest, a backrest coupled at a first end to said armrest and a second armrest coupled to a section end of said backrest, said bolster disposed in contacting relationship with said seat cushion;

(e) a second inner lining disposed in contacting relationship with and substantially covering said bolster, said second inner lining comprised of a material, having a relatively low coefficient of friction and which, when under tension, is capable of stretching approximately twice in each of its length and width dimensions as when not under tension;

(f) a readily removable and replaceable second outer material disposed in slidable relationship with and substantially covering said second inner lining;

(g) means for removably securing said first and second outer materials to said seat cushion and bolster, respectively, whereby said first and second inner linings and said first and second outer materials fit conformly with respect to the contours of said seat cushion and bolster respectively.

7. The sofa defined by claim 6 further comprising a substantially rigid member disposed within said bolster, said rigid member adapted to maintain a planar relationship between said first and second armrests and said backrest.

8. The sofa defined by claim 6 further comprising a support member having first and second L-shaped members, each of said L-shaped members having a first leg and a second leg in perpendicular relationship, a connecting member coupled to each of said first legs whereby said L-shaped members are in parallel relationship, each of said first legs disposed adjacent said backrest, each of said second legs disposed between said seat cushion and the floor on which said sofa sits, whereby said bolster is supported by said support member.

* * * * *